US006332611B1

(12) United States Patent
Tomita

(10) Patent No.: US 6,332,611 B1
(45) Date of Patent: Dec. 25, 2001

(54) SHEET CONVEYING PATH SWITCHING DEVICE AND IMAGE FORMING APPARATUS USING THE SHEET CONVEYING PATH SWITCHING DEVICE

(75) Inventor: Kan Tomita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/570,178

(22) Filed: May 12, 2000

(30) Foreign Application Priority Data

May 24, 1999 (JP) ..... 11-143554
Apr. 3, 2000 (JP) ..... 12-100918

(51) Int. Cl.[7] ..... B65H 5/02
(52) U.S. Cl. ..... 271/273; 271/303
(58) Field of Search ..... 271/264, 273, 271/303

(56) References Cited

U.S. PATENT DOCUMENTS 4,945,390 * 7/1990 Hasegawa et al. ..... 271/303 X
5,443,255 * 8/1995 Nanba et al. ..... 271/273

FOREIGN PATENT DOCUMENTS 5-51158 3/1993 (JP) .
2530507 6/1996 (JP) .
10-72174 3/1998 (JP) .

* cited by examiner

*Primary Examiner*—David H. Bollinger
(74) *Attorney, Agent, or Firm*—Oblon, Spivak, McClelland, Maier & Neustadt, P.C.

(57) ABSTRACT

A sheet conveying path switching device for use in an image forming apparatus includes a supporting member. The supporting member includes two fulcrums for supporting a separation pick and for rotatively moving the supporting member itself. An engagement portion is formed in a sheet guide plate fixed to a cover opening a space around the separation pick for removing a jammed sheet. An elastic member of the supporting member engages in the engagement portion. When the cover is opened, the separation pick and the supporting member open together with the cover by rotatively moving about the second fulcrum. When a jammed sheet is jammed between the separation pick and the cover, the cover opens without moving the separation pick and the supporting member while the elastic member is disengaged from the engagement portion.

16 Claims, 12 Drawing Sheets

SHEET CONVEYING PATH SWITCHING DEVICE AND IMAGE FORMING APPARATUS USING THE SHEET CONVEYING PATH SWITCHING DEVICE

BACKGROUND OF THE INVENTION

1. Field of the Invention

The present invention relates to a sheet transfer apparatus for use in an image forming apparatus, such as a copying machine, a facsimile, a printer, etc., and more particularly to a sheet transfer apparatus having a sheet transfer path selection mechanism.

2. Discussion of the Background

In an image forming apparatus, such as a copying machine, a facsimile, a printer, etc., a sheet conveying path switching mechanism for selecting a path in which a sheet is transferred is widely known. For example, in image forming apparatuses that include a sorter, a mailbox, and a duplex unit to form an image on both sides of a sheet besides an exit tray, in order to transfer a sheet to one of the above-mentioned units, a separation pick or a separation plate (hereinafter collectively referred to as a "separation pick") is generally used to switch over a sheet conveying path. Commonly, a sheet guide plate is provided in the vicinity of the separation pick to form the sheet transfer path together with the separation pick so that the sheet is conveyed through the selected path.

However, in an existing sheet conveying path switching mechanism, a jammed sheet cannot be removed at all or can only be removed with difficulty. Therefore, when a sheet is jammed where the conveying path is divided, the jammed sheet has to be removed by pulling it out either from an upstream or a downstream point of the sheet conveying path dividing section. Especially when the sheet has been folded and jammed, it may be difficult to remove the sheet, and further the sheet or the apparatus may be damaged when the sheet is pulled out.

There are two types of structures in existing sheet conveying path switching mechanisms in which a jammed sheet can be removed at the sheet conveying path switching section. A first type is configured such that either of two sheet guide plates of upper and lower or right and left is opened together with a cover. A second type is configured such that the separation pick and a sheet guide plate having a fulcrum for a rotative movement of the separation pick are opened together with the cover. In the former configuration, the jammed sheet can be easily removed when the jammed sheet is in front of the separation pick (when the cover is opened). However, when the jammed sheet is behind the separation pick, the jammed sheet cannot be easily removed. Especially, the smaller the apparatus is in size, the harder it is to remove a jammed sheet. In the latter configuration, the removability of a jammed sheet behind the separation pick is improved. However, in a case that a large-size sheet is in front of the separation pick and neither a leading edge nor a trailing edge of the sheet is in an opened up space when the cover is opened, the cover cannot be opened because the sheet, which is caught between sheet guide plates provided upstream and downstream of the sheet conveying path dividing section, interferes with the movement of the separation pick. When the cover is forcibly opened, the separation pick may be damaged.

FIG. 12 illustrates an example of a background sheet conveying path switching mechanism, having the above-described first type of configuration. A separation pick 51 is provided above a fixing unit 50 of an image forming apparatus, and a sheet conveyed from the fixing unit 50 in an upward direction is then transported either to the left (in the direction indicated by an arrow a) or to the upward direction (in the direction indicated by an arrow b) by switching a path by the separation pick 51. A cover 53 is configured to open/close, and a sheet guide plate and a driven roller of a pair of sheet conveying rollers to convey the sheet from the fixing unit 50 in the upward direction are opened together with the cover 53.

According to the example of the background sheet transfer path selection mechanism illustrated in FIG. 12, a jammed sheet J can be easily removed when the jammed sheet J is on the right side of the separation pick 51 (in front of the separation pick 51 when the cover 53 is opened). However, when the jammed sheet J is behind the separation pick 51 as illustrated in FIG. 12, the jammed sheet J cannot be easily removed.

FIG. 13 illustrates an example of another background sheet conveying path switching mechanism, having the above-described second type of configuration. The separation pick 51 is supported by a sheet guide plate 52, and the sheet guide plate 52 and the separation pick 51 can be opened/closed together with the cover 53.

According to the example of the background sheet conveying path switching mechanism illustrated in FIG. 13, when a jammed sheet J is jammed behind the separation pick 51, the jammed sheet can be removed without difficulty by opening the sheet guide plate 52 and the separation pick 51 together with cover 53. However, when the sheet J is jammed being caught between the fixing unit 50 and sheet guide plates or a pair of sheet conveying rollers 81 located above the separation pick 51 as illustrated in FIG. 13, the cover 53 cannot be opened because the jammed sheet J interferes with the movement of the separation pick 51. When the cover 53 is forcibly opened, the jammed sheet J may be torn or the separation pick 51 may be damaged. As illustrated in FIG. 14, the cover 53 can be opened when the top part of the jammed sheet J is not caught, however, the jammed sheet cannot be removed easily because the separation pick 51 is located on the jammed sheet J.

SUMMARY OF THE INVENTION

The present invention has been made in view of the above-discussed and other problems and addresses the above-discussed and other problems.

The preferred embodiments of the present invention advantageously provide a novel sheet conveying device having a sheet conveying path switching device with improved removability of a jammed sheet for use in an image forming apparatus.

According to an embodiment of the present invention, a sheet conveying device with a sheet conveying path switching device for use in an image forming apparatus includes a separation pick supporting member for pivotably supporting a separation pick and a cover opening a section around where the separation pick is located to remove a jammed sheet. The separation pick supporting member includes a first fulcrum for supporting the separation pick and a second fulcrum for rotatively moving the supporting member depending on or independently of the cover.

The sheet transfer device with the sheet separation path selection further includes a latching device for removably engaging the cover. The latching device connects the separation pick supporting member and the cover and is disengaged when a force is exerted to interfere with the rotative movement of the separation pick supporting member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
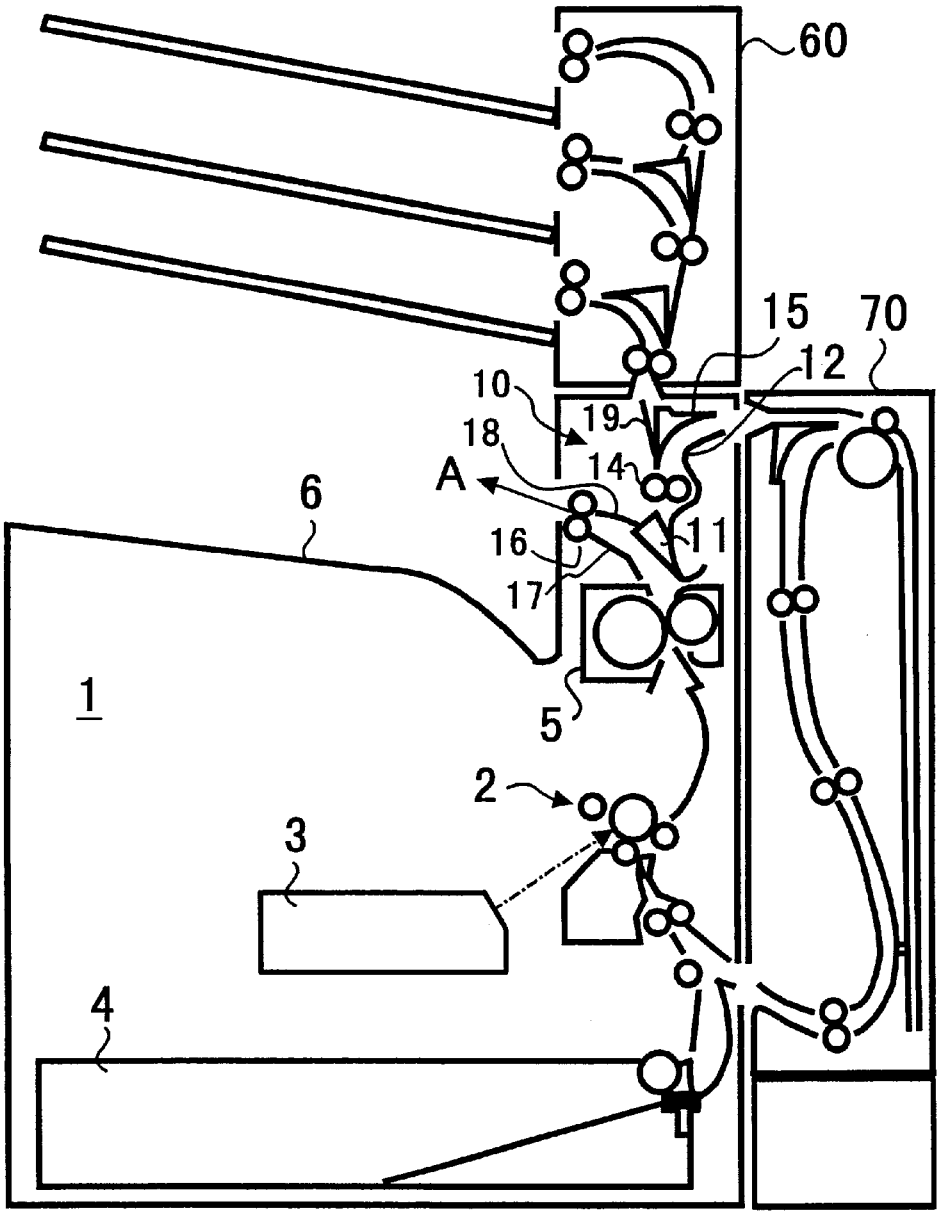
FIG. 1 is a sectional view illustrating a part of an image forming apparatus that has a sheet transfer path selection mechanism according to an example of the present invention.

Referring now to the drawings, wherein like reference numerals designate identical or corresponding parts throughout the several views, FIG. 1 is a sectional view illustrating an internal construction of a printer as an example of an image forming apparatus that has a sheet conveying path switching mechanism according to an embodiment of the present invention.

A main body of an image forming apparatus 1 illustrated in FIG. 1 includes an image forming unit 2, an optical writing unit 3, a sheet feeding unit 4, a fixing unit 5, and a sheet conveying path dividing section 10. An add-on sheet discharging unit 60 and a sheet reverse unit 70 are also provided.

A laser beam light according to image data is irradiated from the optical writing unit 3 to a photoconductive element in the image forming unit 2 and thereby an electrostatic latent image is formed on a surface of the photoconductive element. The latent image is developed into a visible toner image by a developing device. The toner image is then transferred to a sheet that has been conveyed from the sheet feeding unit 4. The toner image is fixed onto the sheet in the fixing unit 5. Then the sheet is discharged to an exit tray 6 as indicated by an arrow A in FIG. 1.

In the sheet conveying path dividing section 10, there are provided a first separation pick 11, a sheet guide plate 12, a pair of sheet conveying rollers 14, a second separation pick 15, a pair of sheet discharging rollers 16, and sheet guide plates 17, 18, and 19. The first separation pick 11 and the second separation pick 15 are pivoted to respective positions illustrated in FIGS. 1 and 2 so as to be switchable (movable). A switching of each separation pick 11, 15 is performed by a solenoid (not shown).

When a sheet is discharged to the exit tray 6 after passing through the fixing unit 5, the first separation pick 11 is switched to the position illustrated in FIG. 1 such that the sheet passes to the left side of the first separation pick 11 and is guided by the guide plates 17 and 18 to the pair of sheet discharging rollers 16 to be discharged to the exit tray 6.

Figure 2:
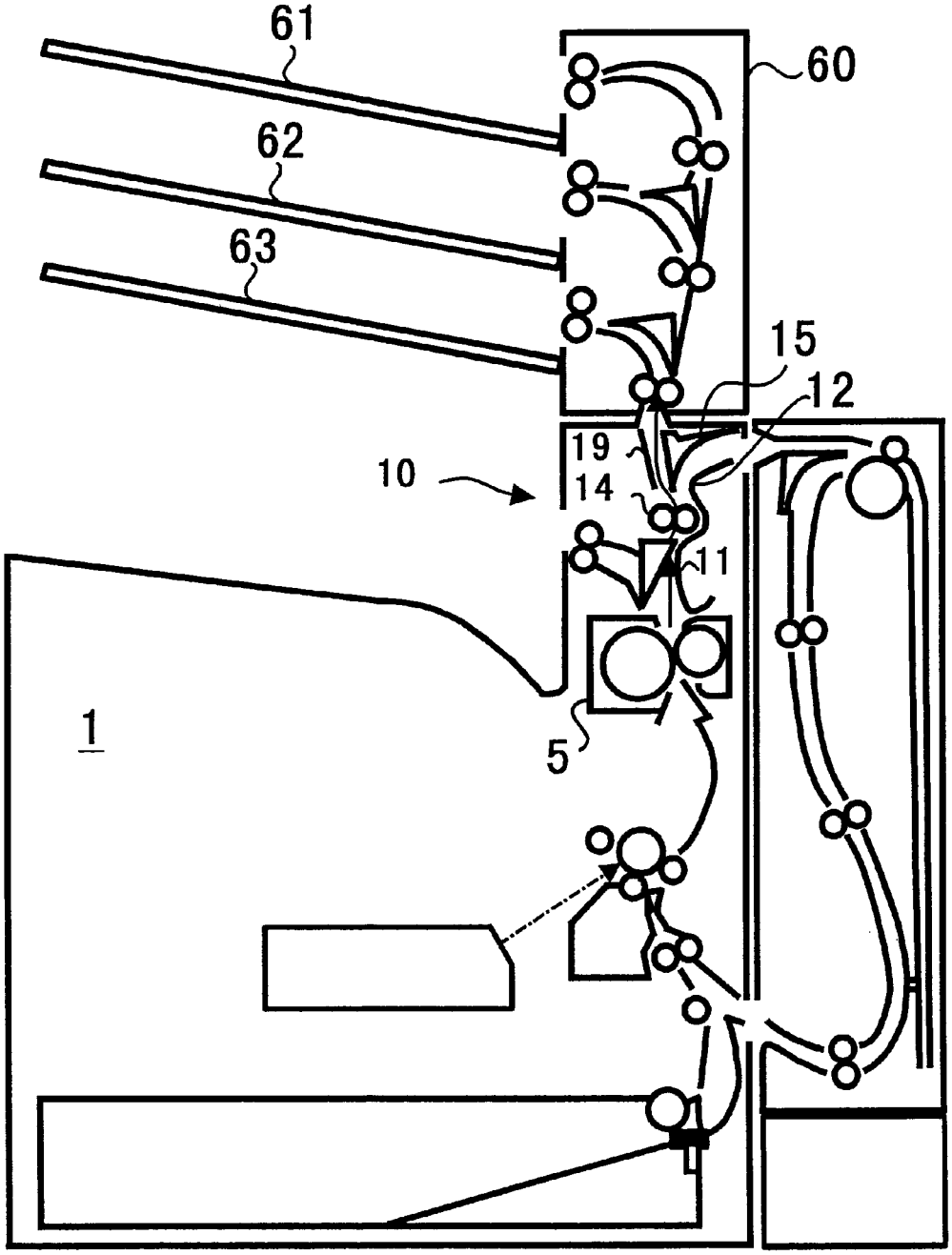
FIG. 2 is a sectional view explaining switching of a sheet conveying path in the image forming apparatus of FIG. 1.

FIG. 2 illustrates a state of the sheet conveying path dividing section 10 conveying a sheet passed through the fixing unit 5 to the add-on sheet discharging unit 60 and to discharge the sheet to one of exit trays 61, 62, 63 of the add-on sheet discharging unit 60. When the sheet is conveyed to the add-on sheet discharging unit 60, the first separation pick 11 and the second separation pick 15 are switched to respective positions illustrated in FIG. 2. The sheet is guided by the first separation pick 11 and the sheet guide plate 12 and is conveyed to the pair of sheet conveying rollers 14 which conveys the sheet in an upward direction. Then the sheet is conveyed, guided by the guide plate 19 and the second separation pick 15, to the add-on sheet discharging unit 60.

Figure 3:
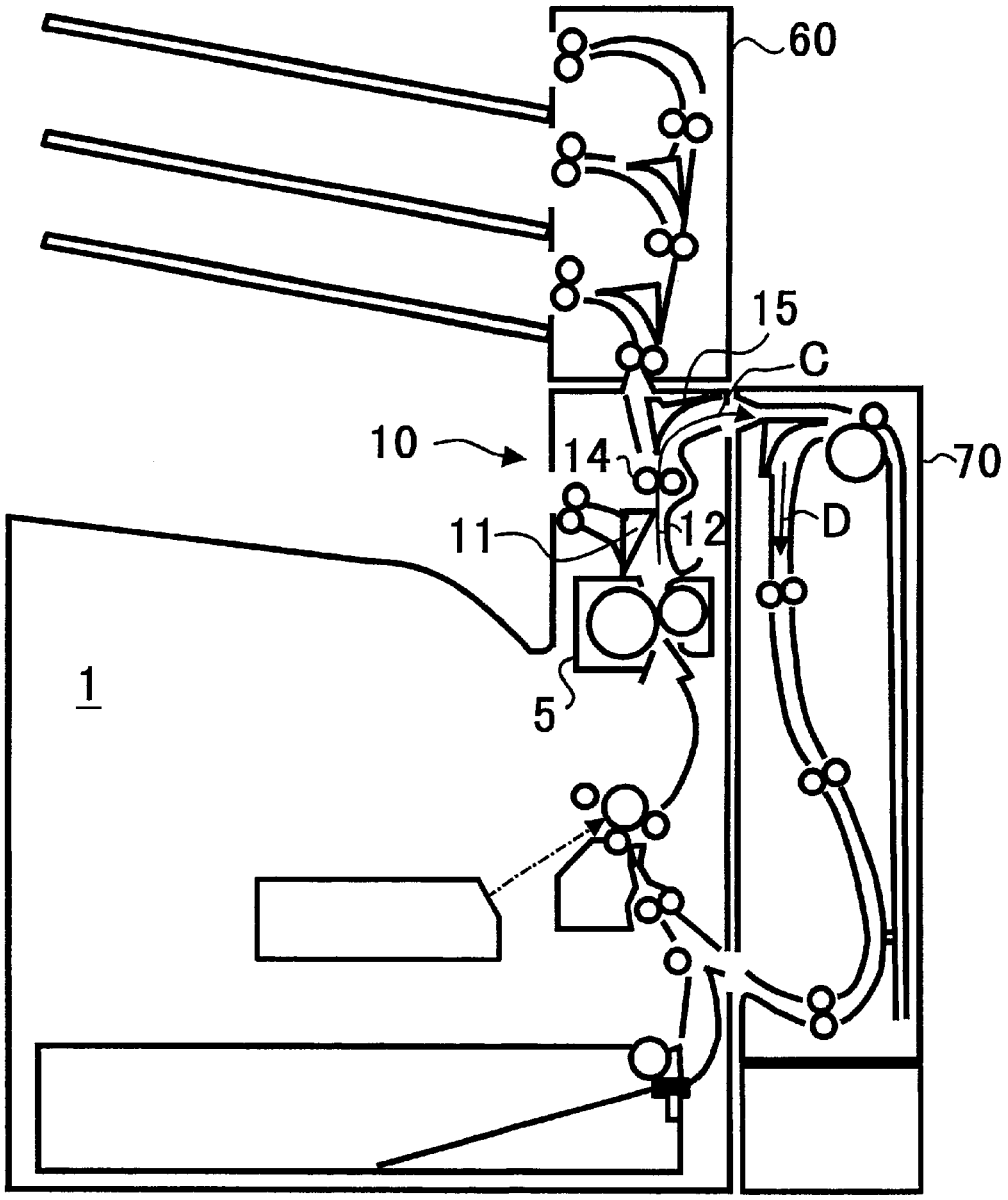
FIG. 3 is a sectional view explaining another switching of a sheet conveying path in the image forming apparatus of FIG. 1.

FIG. 3 illustrates a state of the sheet conveying path dividing section 10 conveying a sheet passed through the fixing unit 5 to the sheet reverse unit 70 to form an image on both sides of the sheet. When the sheet is conveyed to the sheet reverse unit 70, the first separation pick 11 and the second separation pick 15 are switched to respective positions illustrated in FIG. 3. The sheet is guided by the first separation pick 11 and the sheet guide plate 12 and is conveyed to the pair of sheet conveying rollers 14 which conveys the sheet in an upward direction. Then the sheet is conveyed in the right direction in FIG. 3 as indicated by an arrow C in FIG. 3 guided by the second separation pick 15 that has been switched to the position illustrated in FIG. 3. Then the sheet is conveyed to the sheet reverse unit 70.

The sheet is reversed by being conveyed in the direction indicated by an arrow D in FIG. 3 and is conveyed again to the main body of the image forming apparatus 1 where an image is formed on a backside of the sheet. The sheet having an image on the backside is discharged to the exit tray 6 on one of the exit trays 61, 62, and 63 of the add-on sheet discharging unit 60, as illustrated in FIG. 1 or FIG. 2.

Figure 4:
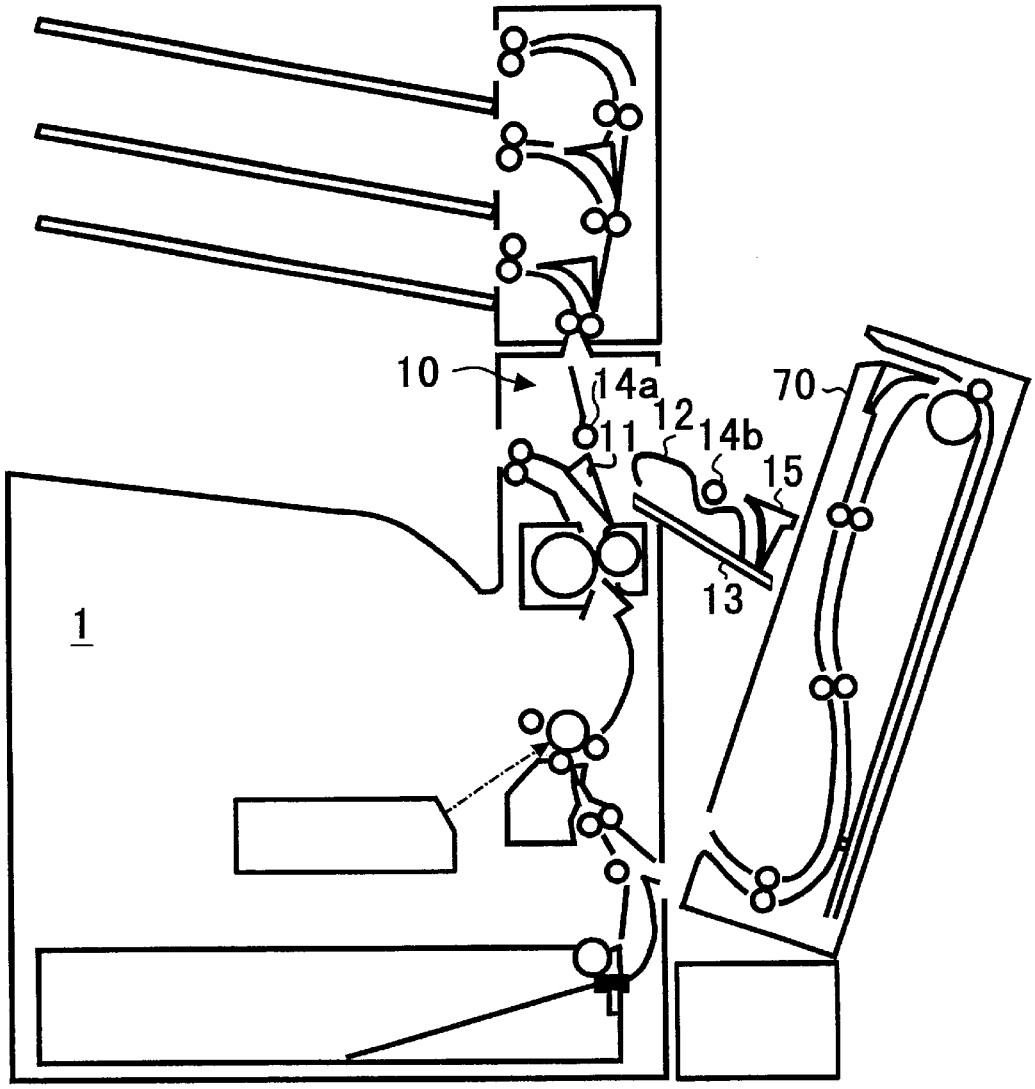
FIG. 4 is a sectional view illustrating a part of the image forming apparatus of FIG. 1 with a sheet conveying path dividing section cover opened.

FIG. 4 illustrates a state of the sheet conveying path dividing section 10 when a sheet conveying path dividing section cover 13 (hereinafter referred to as the "cover") is opened. The cover 13 is provided at the right side of the sheet conveying path dividing section 10 of the main body of the image forming apparatus 1 as shown in FIG. 4. When a sheet is jammed in the sheet conveying path dividing section 10, the jammed sheet is removed by opening the cover 13.

When a sheet is jammed in the sheet conveying path dividing section 10, the sheet reverse unit 70 is opened on a fulcrum positioned at an underside of the sheet reverse unit 70 and then the cover 13 is opened as illustrated in FIG. 4. The cover 13 is configured to open and close on a fulcrum positioned in the vicinity of an underside edge of the cover 13. The guide plate 12 located on the right side of the first separation pick 11 is supported by the cover 13 and is opened together with the cover 13 when the cover 13 is opened. A driven roller 14*b* of the pair of sheet conveying rollers 14 and the second separation pick 15 are attached to the cover 13 (to be precise, those are attached to a not shown guide member that opens and closes together with the cover 13), and consequently the driven roller 14*b* and the second separation pick 15 are opened and closed together with the cover 13. When the cover 13 is closed, the driven roller 14*b* press-contacts a drive roller 14*a* of the pair of sheet conveying rollers 14 at a predetermined pressure.

Figure 5:
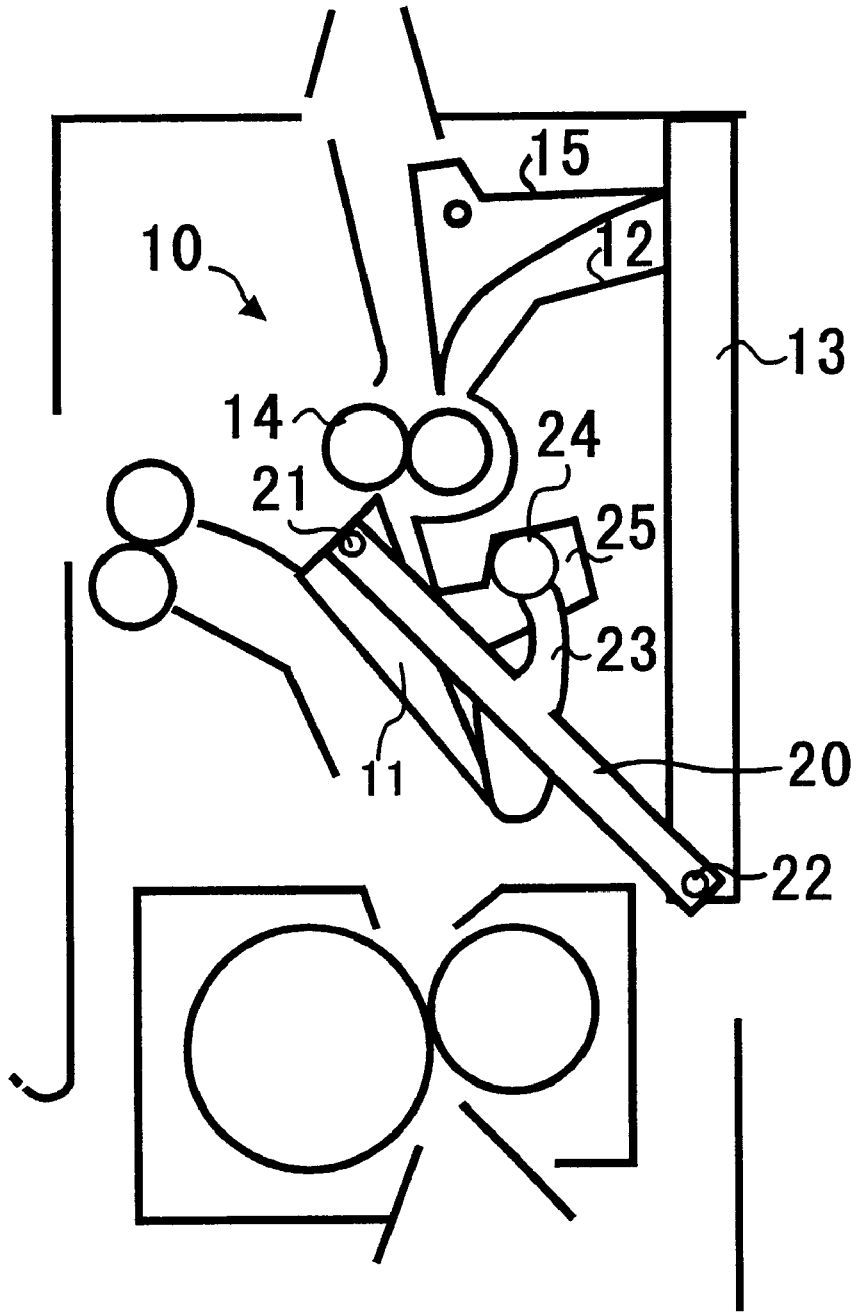
FIG. 5 is an enlarged sectional view illustrating the construction of a sheet conveying path switching mechanism.

As illustrated in FIG. 5, the cover 13 is configured to open and close on a second fulcrum 22 relative to the main body of the image forming apparatus 1. One end of a supporting member 20 is connected to the second fulcrum 22. The supporting member 20 is configured to be rotatable independently of the cover 13. The separation pick 11 is pivoted on a first fulcrum 21 positioned at another end of the supporting member 20. According to the embodiment of the present invention, the first separation pick 11 is pivoted neither on the main body of the image forming apparatus 1 nor on the sheet guide plate 12 fixed to the cover 13, but on the supporting member 20 that is rotatable independently of the cover 13.

The supporting member 20 configured to be rotatable independently of the cover 13 is also configured to move rotatively together with the cover 13 as described below. The supporting member 20 includes the first fulcrum 21 to support the first separation pick 11 and the second fulcrum 22 to move rotatively together with the cover 13 or independently of the cover 13.

Further, the supporting member 20 includes a projection 23 of an arm-like shape extending from a main body portion of the supporting member 20, and an elastic member 24 is fixed onto a tip of the projection 23. The sheet guide plate 12 located on the right side of the first separation pick 11 (as shown in FIG. 5) includes an engagement portion 25 which is formed by a part of the sheet guide plate 12 being dented toward the cover 13.

According to the embodiment of the present invention, the projection 23 and the engagement portion 25 function to latch the supporting member 20 and the cover 13 (the sheet guide plate 12) together. As illustrated in FIG. 5, when the cover 13 is closed, the elastic member 24 of the supporting member 20 is engaged in the engagement portion 25 of the sheet guide plate 12. According to the embodiment of the present invention, the engagement portion 25 and the elastic member 24 are a latch part and a latched part respectively in the latch. The elastic member 24 may be fixed to a front-end part (a jaw) of the engagement portion 25 instead of onto the tip of the projection 23.

Figure 6A:
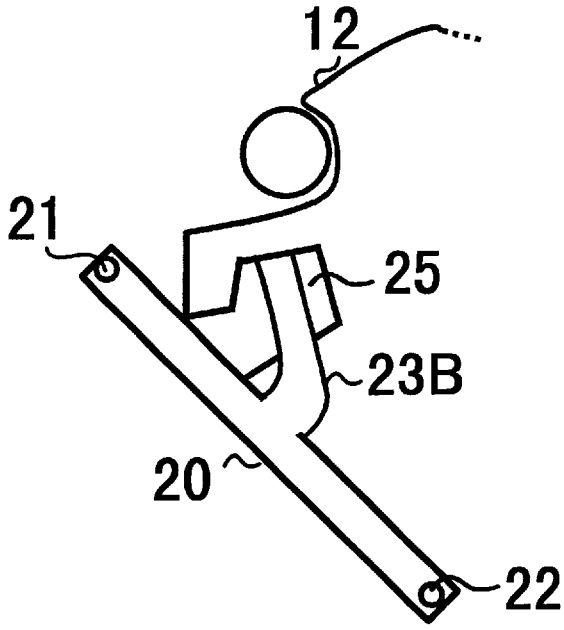
FIGS. 6A and 6B are enlarged views illustrating another example of a separation pick supporting member.
Figure 6B:
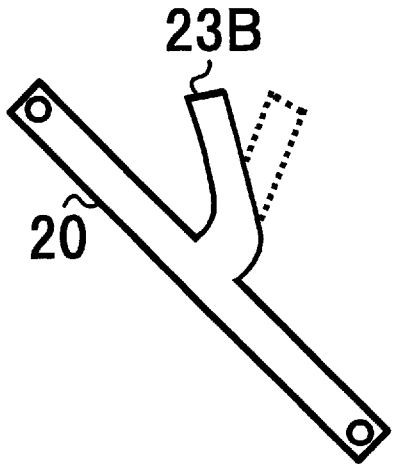

FIGS. 6A and 6B illustrate another example of a separation pick supporting member 20 of the present invention. The supporting member 20 includes the projection 23B formed as an elastic member. As a material for the projection 23B, for example, polyacetal resin (POM) may be used. In the example shown in FIG. 6A, the projection 23B and the engagement portion 25 constitute a latch for latching the supporting member 20 and the cover 13 (the sheet guide plate 12). The engagement portion 25 and the projection 23B function as the latch part and the latched part respectively in the latch. The engagement portion 25 instead of the projection 23B my be made of an elastic member or both of them may be made of an elastic member.

According to the example illustrated in FIG. 6A, when the cover 13 is closed, the tip of the projection 23B of the supporting member 20 is latched by the engagement portion 25 of the sheet guide plate 12. When the latch is disengaged, the projection 23B changes its shape as indicated by the dotted line in FIG. 6B. Likewise, the projection 23B changes its shape when the engagement portion 25 latches the projection 23B. Because the sheet transfer path selection 10 functions in substantially the same way when the supporting member 20 is configured as illustrated in FIG. 5 and FIG. 6A, hereinafter the present invention will be described based on the supporting member 20 configured as illustrated in FIG. 5.

Figure 7:
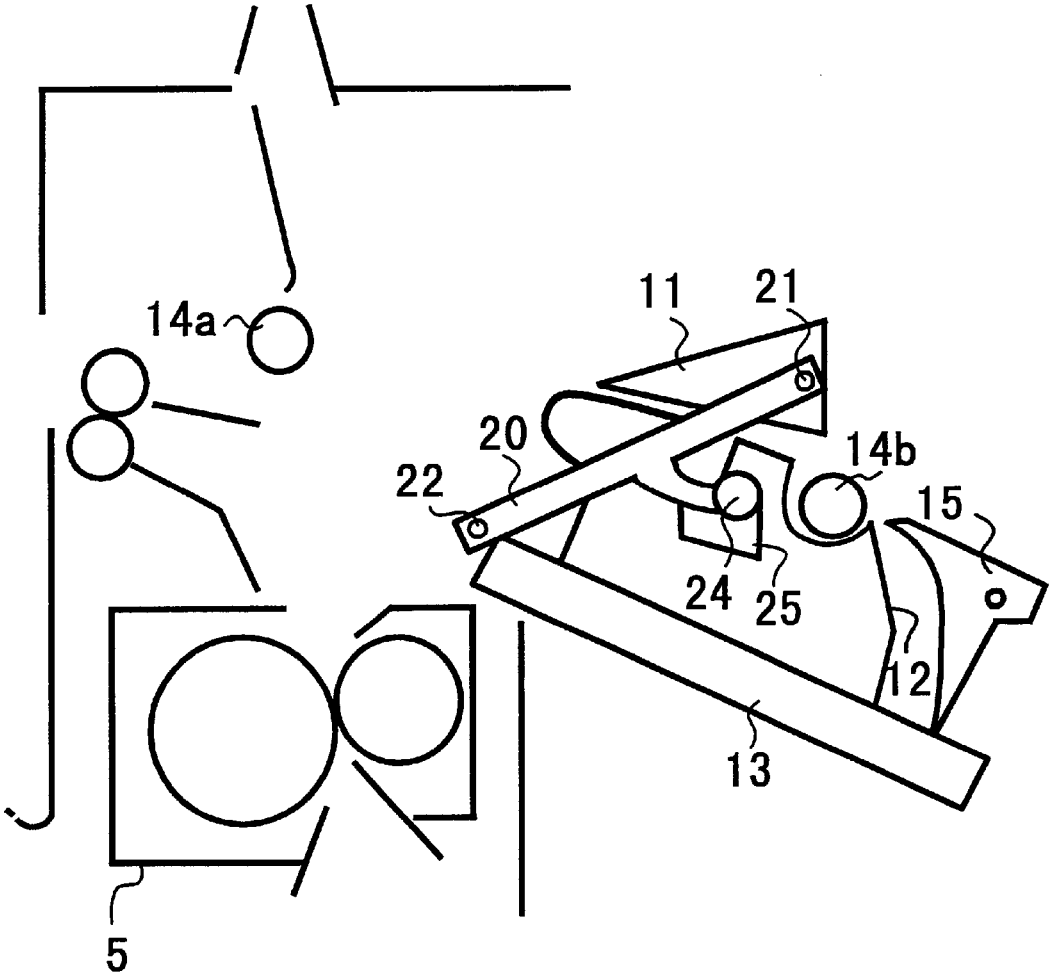
FIG. 7 is an enlarged sectional view illustrating a state that a first separation pick is opened together with the sheet conveying path dividing section cover.

As illustrated in FIG. 7, when the cover 13 is rotatively opened on the second fulcrum 22, the sheet guide plate 12, the driven roller 14*b*, and the second separation pick 15 are opened together with the cover 13. At this time, because the supporting member 20 is configured to be rotatable on the second fulcrum 22 and the elastic member 24 of the supporting member 20 is engaged in the engagement portion 25 of the sheet guide plate 12, the supporting member 20 is also rotatively opened together with the cover 13. Naturally, the first separation pick 11 attached to the supporting member 20 also rotatively moves on the second fulcrum 22 together with the cover 13. Therefore, when the cover 13 is opened, the sheet transfer path selection section 10 above the fixing unit 5 is opened wide. Thus, when the elastic member 24 of the supporting member 20 is engaged in the engagement portion 25 of the sheet guide plate 12, the supporting member 20 and the first separation pick 11 are opened together with the cover 13.

Since the supporting member 20 and the first separation pick 11 are moved by the engagement force of the engagement portion 25 and the elastic member 24 when the cover 13 is opened, when a force is exerted to interfere with a rotative movement of the first separation pick 11, the first separation pick 11 and the supporting member 20 do not open (move) even when the cover 13 is opened because the elastic member 24 becomes disengaged from the engagement portion 25 by changing the shape of the elastic member 24.

Figure 8:
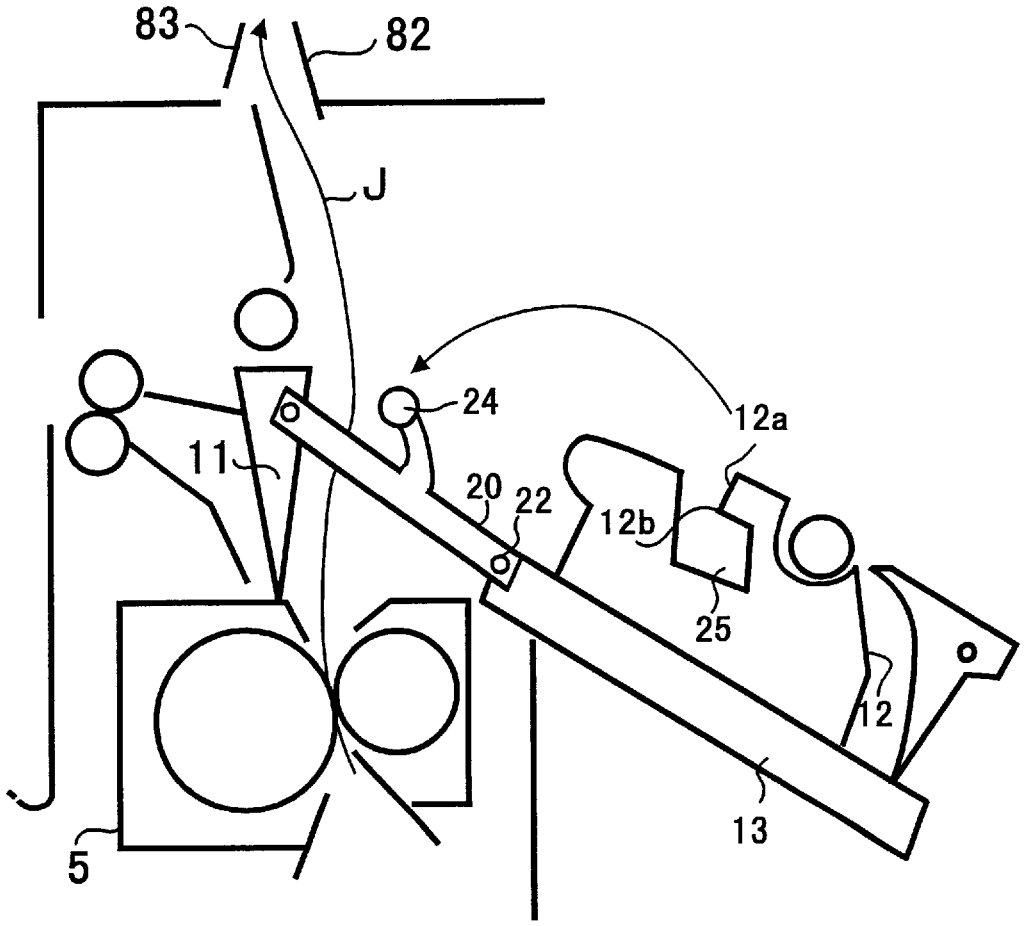
FIG. 8 is an enlarged sectional view illustrating a state that a sheet conveying path dividing section cover is opened independently of the first separation pick of FIG. 7.

As illustrated in FIG. 8, when the cover 13 is opened while a sheet J is jammed on the right side of the first separation pick 11 (especially when a sheet has jammed by being caught between the fixing unit 5 and sheet guide members 82 and 83 or a pair of sheet conveying rollers 81 (shown in FIG. 10)), the jammed sheet J interferes with the movement of the first separation pick 11. Therefore, when the cover 13 is opened, the elastic member 24 is disengaged from the engagement portion 25 by changing the shape of the elastic member 25. Thus, even when the cover 13 is opened (as well as the sheet guide plate 12, the driven roller 14*b*, and the second separation pick 15), the first separation pick 11 (and the supporting member 20) is not opened, thus preventing the sheet J from being torn or the first separation pick 11 from being damaged.

According to an experiment by the inventor of the present invention, the strength of the engagement of the elastic member 24 of the supporting member 20 and the engagement portion 25 of the sheet guide plate 12 is preferably not greater than 5 N (Newton). It is needless to say that the strength of the engagement is large enough to move the supporting member 20 and the first separation pick 11 together with the cover 13 when there is no jammed sheet as illustrated in FIG. 7. The strength of the engagement can be varied and determined according to a construction of a device.

The cover 13 may then be closed after the cover 13 has been opened and the elastic member 24 has been disengaged from the engagement portion 25 (a situation illustrated in FIG. 8), for example in closing the cover 13 after a jammed sheet has been removed. The elastic member 24 is then engaged in the engagement portion 25 when the cover 13 is closed. According to an embodiment of the present invention, an engagement guide part 12*a* is provided on the sheet guide plate 12 such that the elastic member 24 (the tip of the projection 23B in the case of the example shown in FIG. 6) can be easily engaged in the engagement portion 25 by closing the cover 13. When the cover 13 is closed, the cover 13 and the sheet guide plate 12 are rotatively moved on the second fulcrum 22, and the engagement guide part 12*a* is thereby brought into contact with the elastic member 24 as indicated by the broader arrow in FIG. 8. In other words, the engagement guide part 12*a* is provided to contact the elastic member 24 when the cover 13 is closed. Then the engagement guide part 12*a* changes the shape of the elastic member 24 (the projection 23B in the case of the example shown in FIG. 6) so that the elastic member 24 goes beyond a corner 12*b* of the engagement guide part 12*a* to engage in the engagement portion 25. Because the engagement guide part 12*a* is provided in such a manner that the elastic member 24 can be easily engaged in the engagement portion 25 when the cover 13 is closed, the first separation pick 11 can be replaced to its original position at the same time when the cover 13 is closed. Therefore, an operator does not have to pay particular attention to a position of the first separation pick 11 and an alignment of the elastic member 24 and the engagement portion 25.

Figure 9:
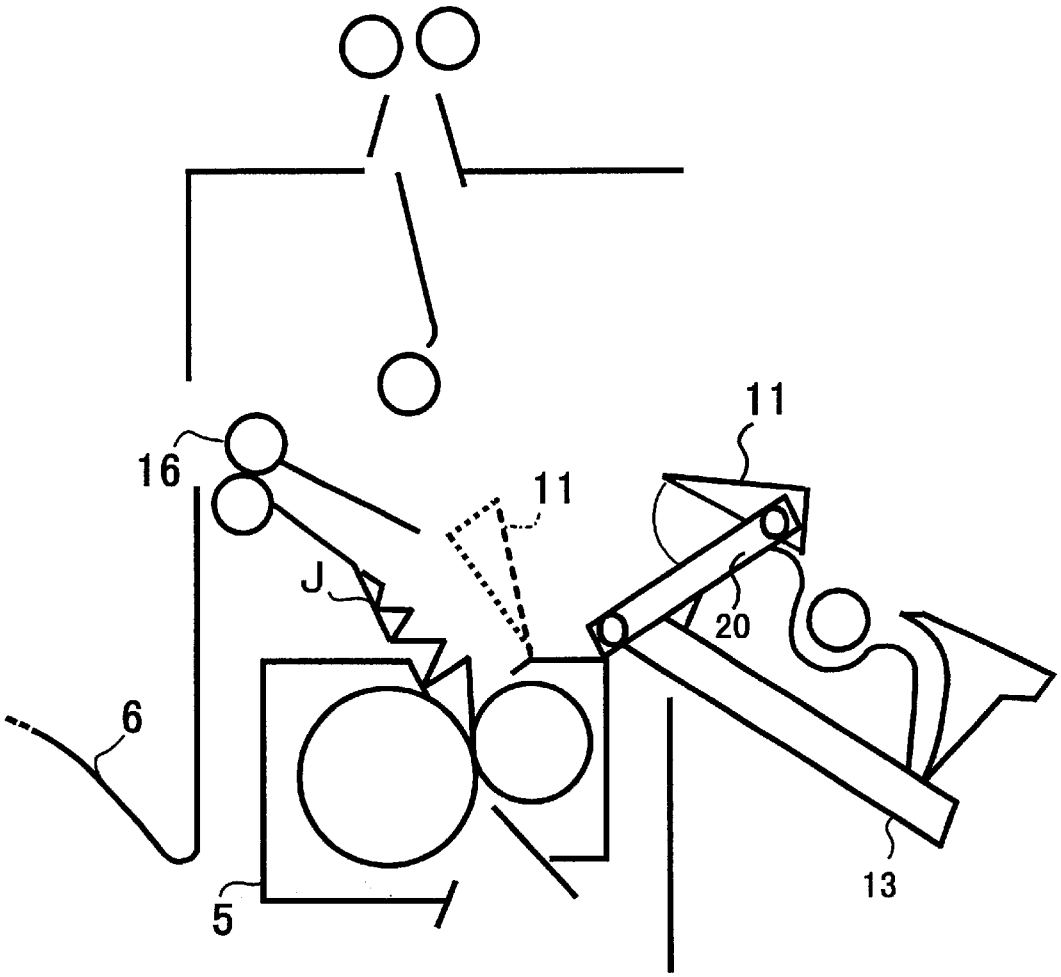
FIG. 9 is a sectional view explaining a removal operation of a jammed sheet in a sheet conveying path of the image forming apparatus of FIG. 1.
Figure 10:
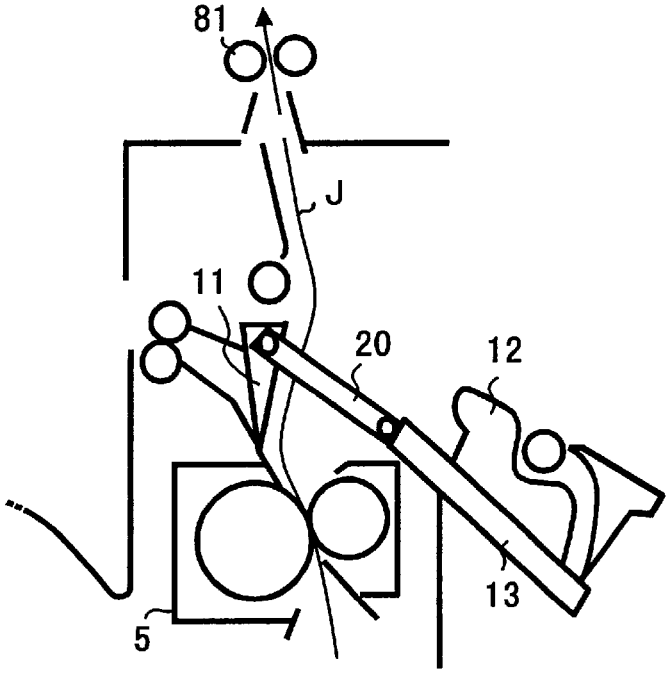
FIG. 10 is a sectional view explaining a removal operation of a jammed sheet in another sheet conveying path of the image forming apparatus of FIG. 1.
Figure 11:
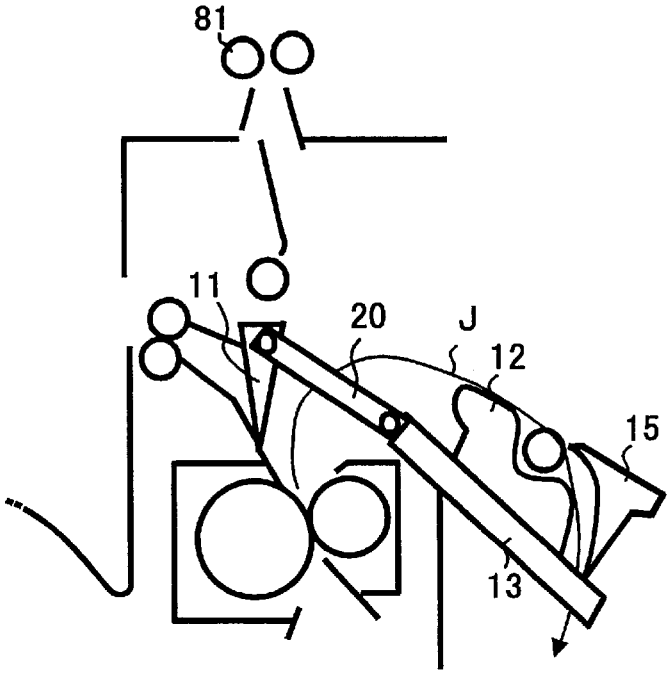
FIG. 11 is a sectional view explaining a removal operation of a jammed sheet in still another sheet conveying path of the image forming apparatus of FIG. 1.

FIGS. 9–11 illustrate a sheet removal operation when a sheet is jammed in the above-described image forming apparatus.

Figure 12:
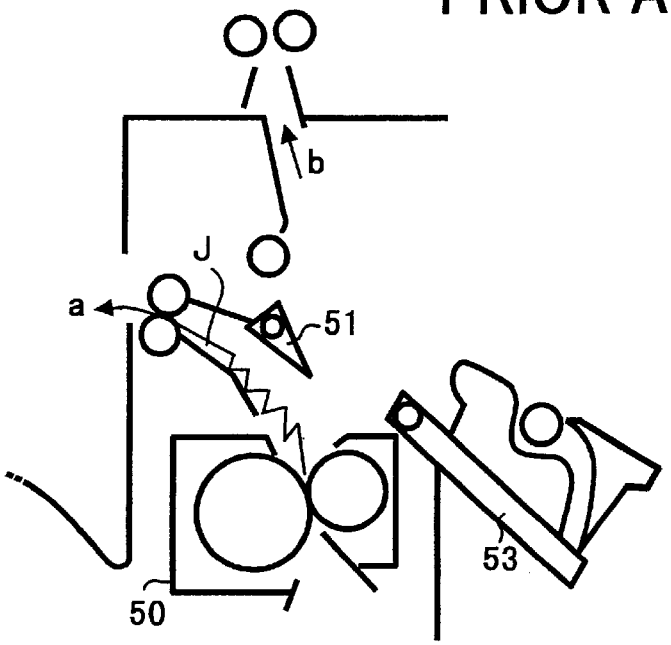
Fig. 12 PRIOR ART
FIG. 12 is a sectional view illustrating an example of a background sheet conveying path switching mechanism.

As illustrated in FIG. 9, when a sheet to be discharged to the exit tray 6 has jammed by being folded like bellows between the fixing unit 5 and the pair of sheet discharging rollers 16, the first separation pick 11 and the supporting member 20 are opened together when the cover 13 (as well as the sheet guide plate 12, the driven roller 14*b*, and the second separation pick 15 as shown in FIG. 7). Because the first separation pick 11 is moved away from the jammed sheet J, thus opening the sheet conveying path dividing section 10 wide to provide an operation space for removing the jammed sheet J, the jammed sheet J can be easily removed. In contrast, in an existing image forming apparatus as illustrated in FIG. 12, a separation pick 51 is not moved even when a cover 53 is opened, and therefore a jammed sheet J is hidden behind the separation pick 51 and can not be easily removed.

Figure 13:
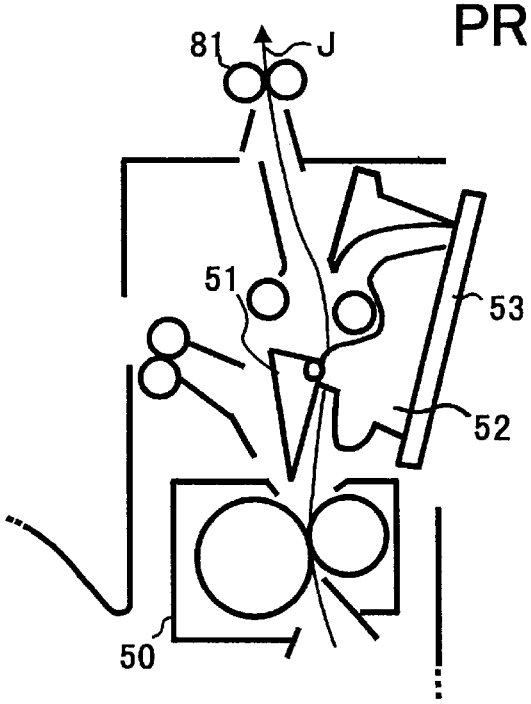
Fig. 13 PRIOR ART
FIG. 13 is a sectional view illustrating another example of a background sheet conveying path switching mechanism.

FIG. 10 illustrates a state in which a sheet J has jammed by being caught between the fixing unit 5 and the pair of sheet conveying rollers 81. In this case, when the cover 13 is opened, the jammed sheet J interferes with the movement of the first separation pick 11 (and the supporting member 20) because the jammed sheet J is jammed on the right side of the first separation pick 11 (between the first separation pick 11 and the sheet guide plate 12). Therefore, as described previously, the elastic member 24 provided on the supporting member 20 is disengaged from the engagement portion 25 of the sheet guide plate 12 (see FIG. 8), and the cover 13 is opened without opening the first separation pick 11 (and the supporting member 20). Thus, an operator can easily reach and remove the jammed sheet J with his or her hands. In contrast, in an existing image forming apparatus as illustrated in FIG. 13, because the separation pick 51 is fulcrumed in a sheet guide plate 52, when the jammed sheet J is jammed on the right side of the separation pick 51, the jammed sheet J interferes with the movement of the separation pick 51 and thereby the cover 53 cannot be easily opened. When the cover 53 is forcibly opened, the jammed sheet J may be torn or the separation pick 51 may be damaged.

According to the embodiment of the present invention, when the cover 13 is opened while a leading portion of the sheet is caught by members disposed at an upstream side of the sheet transfer path selection section 10 (e.g. the sheet guide plates 82 and 83 in FIG. 8 or the pair of sheet conveying rollers 81) and a trailing portion of the sheet is caught by members disposed at a downstream side of the sheet transfer path selection section 10 (e.g. the fixing unit 5), the sheet guide plate 12 is disengaged from the supporting member 20 as illustrated in FIG. 10 (the elastic member 24 or the projection 23B is disengaged from the engagement portion 25). However, when the cover 13 is opened while either the leading or the trailing portion of the sheet is caught by the members located at the upstream or the downstream side of the sheet transfer path selection section 10, because an edge of the sheet which is not caught can move, the engagement of the supporting member 20 and the cover 13 is maintained, and thereby the supporting member 20 and the first separation pick 11 are opened together with the cover 13.

Figure 14:
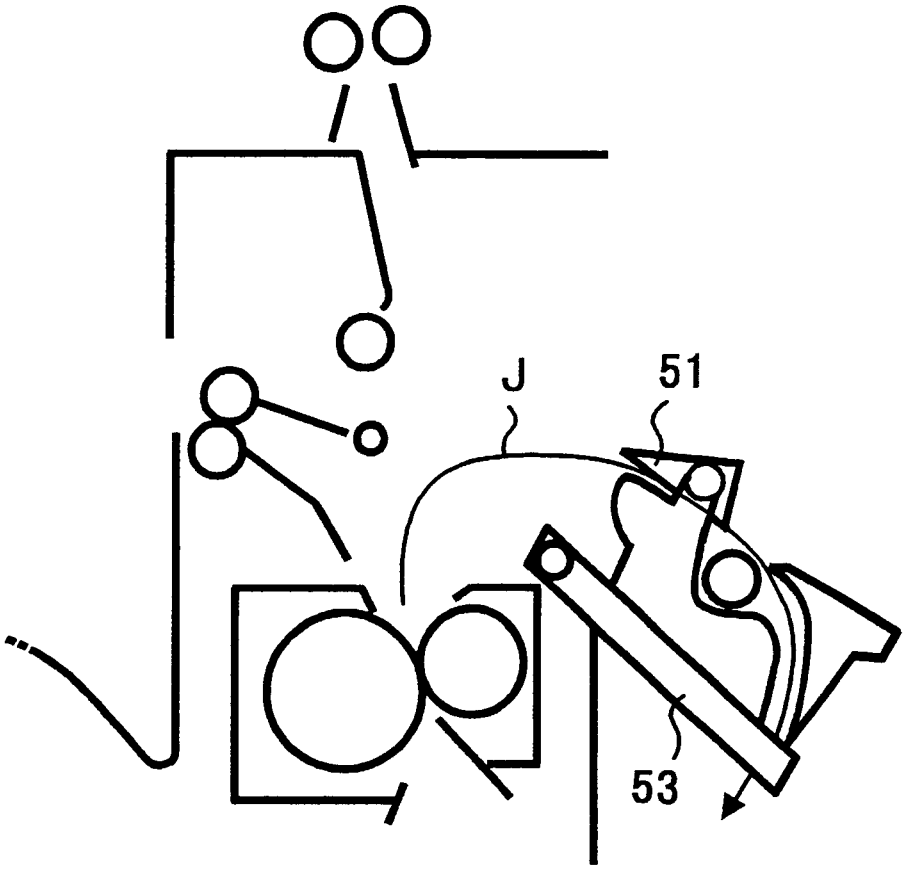
Fig. 14 PRIOR ART
FIG. 14 is a sectional view illustrating a removal operation of a jammed sheet in a background sheet conveying path switching mechanism.

FIG. 11 illustrates a state of a sheet removal operation when a sheet is jammed while the sheet is being conveyed to the sheet reverse unit 70 (see FIG. 1). The jammed sheet J is jammed on the right side of the first separation pick 11, and a leading edge of the sheet has passed through the sheet guide plate 12 and the second separation pick 15 and is about to enter the sheet reverse unit 70. When the cover 13 is opened, neither the first separation pick 11 nor the supporting member 20 moves together with the cover 13. Therefore, a wide operation space for removing the jammed sheet J is made available above the jammed sheet J, allowing an operator to remove the jammed sheet J without any difficulty. In contrast, in an existing image forming apparatus as illustrated in FIG. 14, when the cover 53 is opened, the separation pick 51 is located on the jammed sheet J interfering with a removal of the jammed sheet J.

As described above, according to the present invention, the supporting member 20 includes the first fulcrum 21 for supporting the first separation pick 11 and the second fulcrum 22 for rotatively moving the supporting member 20. Because the supporting member 20 is configured to rotatively open together with the cover 13 or independently of the cover 13, the first separation pick 11 can be opened together with the cover 13 and also the cover 13 can be opened without moving the first separation pick 11. Thus, a jammed sheet jammed on either side of the first separation pick 11 can be easily removed. Further, even when the jammed sheet is jammed on the right side of the first separation pick 11 (on the side of the cover 13), neither the jammed sheet nor the first separation pick 11 may be torn or damaged respectively by opening the cover 13.

Obviously, numerous additional modifications and variations of the present invention are possible in light of the above teachings. It is therefore to be understood that within the scope of the appended claims, the present invention may be practiced otherwise than as specifically described herein.

This documents claims priority and contains subject matter related to Japanese Patent Applications Nos. 11-143554 filed on May 24, 1999, and 2000-100918 filed on Apr. 3, 2000, and the entire contents thereof are herein incorporated by reference.

What is claimed is:

1. A sheet conveying path switching device for use in an image forming apparatus, comprising:

a separation pick configured to switch a sheet conveying path;

a cover configured to cover and open a space around said separation pick for removing a jammed sheet; and a separation pick supporting member configured to pivotably support said separation pick, said separation pick supporting member including:

a first fulcrum configured to support said separation pick; and a second fulcrum configured to rotatively move said supporting member both independently of and integrally with said cover.

2. A sheet conveying path switching device for use in an image forming apparatus, comprising:

a separation pick configured to switch a sheet conveying path;

a cover configured to cover and open a space around said separation pick for removing a jammed sheet; and a separation pick supporting member configured to pivotably support said separation pick, said separation pick supporting member including:

a first fulcrum configured to support said separation pick;

a second fulcrum configured to rotatively move said cover; and a latch configured to detachably engage with said cover.

3. An image forming apparatus, comprising:

a sheet conveying path switching device, including:

a separation pick configured to switch a sheet conveying path;

a cover configured to cover and open a space around said separation pick for removing a jammed sheet; and a separation pick supporting member configured to pivotably support said separation pick, said separation pick supporting member including a first fulcrum configured to support said separation pick and a second fulcrum configured to rotatively move said supporting member both independently of and integrally with said cover.

4. An image forming apparatus, comprising:

a sheet conveying path switching device, including:

a separation pick configured to switch a sheet conveying path;

a cover configured to cover and open a space around said separation pick for removing a jammed sheet; and a separation pick supporting member configured to pivotably support said separation pick, said separation pick supporting member including:

a first fulcrum configured to support said separation pick;

a second fulcrum configured to rotatively move said cover; and a latch configured to detachably engage with said cover.

5. An image forming apparatus according to claim 4, wherein:

said separation pick supporting member is rotatively moved together with said cover by said latch, and said separation pick supporting member and said cover engaged with each other by said latch are disengaged when a force is exerted to interfere with the rotative movement of said separation pick supporting member.

6. An image forming apparatus according to claim 4, wherein:

said separation pick supporting member is rotatively moved together with said cover by said latch, and said separation pick supporting member and said cover engaged with each other by said latch are disengaged when said cover is opened when a sheet is jammed between said separation pick supporting member and said cover.

7. An image forming apparatus according to claim 4, wherein:

said separation pick supporting member is rotatively moved together with said cover by said latch, and said separation pick supporting member and said cover engaged with each other by said latch are disengaged when said cover is opened when a sheet is jammed between said separation pick supporting member and said cover with a leading portion and a trailing portion of the sheet caught by members located at upstream and downstream sides respectively in a moving direction of the sheet.

8. An image forming apparatus according to claim 4, wherein:

said separation pick supporting member is rotatively moved together with said cover by said latch, and said separation pick supporting member and said cover engaged with each other by said latch are disengaged when said cover is opened when a sheet is jammed between said separation pick supporting member and said cover with a leading portion and a trailing portion of the sheet caught by members located at upstream and downstream sides respectively in a moving direction of the sheet, and said separation pick supporting member and said cover engaged with each other by said latch are maintained engaged when said cover is opened while either the leading or the trailing portion of the sheet is caught by the members located at the upstream or the downstream sides respectively in the moving direction of the sheet.

9. An image forming apparatus according to claim 4, wherein:

said latch includes a latch member and a latched member and at least one of the latch and the latched members is made of an elastic member.

10. An image forming apparatus according to claim 9, wherein:

said latch includes a latching guide part guiding a latch of said latch and latched members.

11. An image forming apparatus according to claim 4, wherein:

said latch includes a latch member and a latched member and a tip of at least one of the latch and the latched members is made of an elastic member.

12. An image forming apparatus according to claim 11, wherein:

said latch includes a latching guide part guiding a latch of said latch and latched members.

13. A sheet conveying path switching device for use in an image forming apparatus, comprising:

separation means for switching a sheet conveying path;

cover means for covering and opening a space around said separation means for removing a jammed sheet; and support means for supporting said separation means, said support means including:

first pivot means for supporting said separation means; and second pivot means for moving said support means both independently of and integrally with said cover means.

14. A sheet conveying path switching device for use in an image forming apparatus, comprising:

separation means for switching a sheet conveying path;

cover means for covering and opening a space around said separation means for removing a jammed sheet; and support means for supporting said separation means, said support means including:

first pivot means for supporting said separation means;

second pivot means for moving said cover means; and latch means for detachably engaging with said cover means.

15. An image forming apparatus, comprising:

sheet conveying path switching means, including:

separation means for switching a sheet conveying path;

cover means for covering and opening a space around said separation means for removing a jammed sheet; and support means for supporting said separation means, said support means including a first pivot means for supporting said separation means and a second pivot means for moving said support means both independently of and integrally with said cover means.

16. An image forming apparatus, comprising:

sheet conveying path switching means, including:

separation means for switching a sheet conveying path;

cover means for covering and opening a space around said separation means for removing a jammed sheet; and support means for supporting said separation pick, said support means including:

first pivot means for supporting said separation means;

second pivot means for moving said cover means; and latch means for engaging with said cover means.

* * * * *